US005671478A

United States Patent [19]

Yen

[11] Patent Number: 5,671,478

[45] Date of Patent: Sep. 30, 1997

[54] CUSHION DEVICE FOR A BODY PART HAVING TWO CURVED PLATES OF DIFFERENT RADII

[75] Inventor: Fu-Hsin Yen, Taipei Hsien, Taiwan

[73] Assignee: Comax Sporting Good Co., Ltd., Chia-I Hsien, Taiwan

[21] Appl. No.: 597,058

[22] Filed: Feb. 5, 1996

[51] Int. Cl.[6] ..... A41D 13/00

[52] U.S. Cl. ..... 2/22; 2/23; 2/455

[58] Field of Search ..... 2/22, 23, 24, 2, 2/16, 455, 456, 459, 461, 463, 464, 465, 466, 467, 2.5

[56] References Cited

U.S. PATENT DOCUMENTS 1,689,558 10/1928 Patten ..... 2/22

1,772,922 8/1930 Volz ..... 2/22

1,772,923 8/1930 Volz ..... 2/22

3,416,156 12/1968 Marvid ..... 2/22

4,599,747 7/1986 Robinson ..... 2/24

5,477,559 12/1995 Clement ..... 2/22

*Primary Examiner*—Gloria Hale

*Attorney, Agent, or Firm*—Panitch Schwarze Jacobs & Nadel, P.C.

[57] ABSTRACT

A cushion device is adapted to be disposed in a carrying bag and includes two curved plates with different radii of curvature. The curved plates are connected to each other and form a void therebetween.

2 Claims, 7 Drawing Sheets

CUSHION DEVICE FOR A BODY PART HAVING TWO CURVED PLATES OF DIFFERENT RADII

BACKGROUND OF THE INVENTION

1. Field of the Invention

The invention relates to a cushion device, more particularly to a cushion device adapted to be disposed in a carrying bag to protect a body part from collision.

2. Description of the Related Art

A conventional cushion device includes a piece of rubber sponge which is to be disposed in a carrying bag that is to be worn around a body part, such as an ankle or elbow, and a plate member placed in the carrying bag in front of the rubber sponge. The rubber sponge and the plate member protect the body part from injury due to impact thereto.

In the conventional cushion device, it is the rubber sponge that provides the cushioning effect and not the plate member. However, the rubber sponge absorbs the sweat of the wearer. When the rubber sponge is soaked with sweat, the weight of wearer of the cushion device increases and the soaked rubber sponge provides a poor cushioning effect.

SUMMARY OF THE INVENTION

Therefore, the main objective of the present invention is to provide a cushion device which does not absorb water and which is light in weight.

Accordingly, the cushion device of the present invention is to be disposed in a carrying bag to protect a body part from collision. The cushion device includes two curved plates with different radii of curvature. The curved plates are connected to each other and form a void therebetween.

In one preferred embodiment, each one of the two curved plates is an elongated plate which is formed with a concave face and a convex face opposite to the concave face. The concave and convex faces of a respective one of the curved plates are defined by two end edges and two longitudinal peripheries which extend respectively between the end edges. The longitudinal peripheries of the curved plate with a smaller radius of curvature are connected to the convex face of the curved plate with a greater radius of curvature.

In another preferred embodiment, each of the curved plates has a concave face, a convex face opposite to the concave face and a common periphery which defines the concave and convex faces. The common periphery of one of the curved plates with a smaller radius of curvature is connected to the convex face of the other one of the curved plates with a greater radius of curvature.

In still another preferred embodiment, each one of the curved plates has a central portion and a peripheral portion around the central portion. The peripheral portion of one of the curved plates has the same radius of curvature as the peripheral portion of the other one of the curved plates. The central portion of the one of the curved plates has a radius of curvature smaller than the radius of curvature of the peripheral portion. The central portion of the other one of the curved plates has a radius of curvature greater than the radius of curvature of the peripheral portion.

Since the void between the two curved plates permit deformation of the curved plates so as to generate a cushion effect upon application of an impact force on the cushion device, the carrying bag can be worn around a body part, such as a leg, and thus the cushion device in the bag serves as a protecting shield for the body part.

BRIEF DESCRIPTION OF THE DRAWINGS

Other features and advantages of the present invention will become more apparent in the following detailed description of the preferred embodiments with reference to the accompanying drawings, in which.

DETAILED DESCRIPTION OF THE PREFERRED EMBODIMENTS

Figure 1:
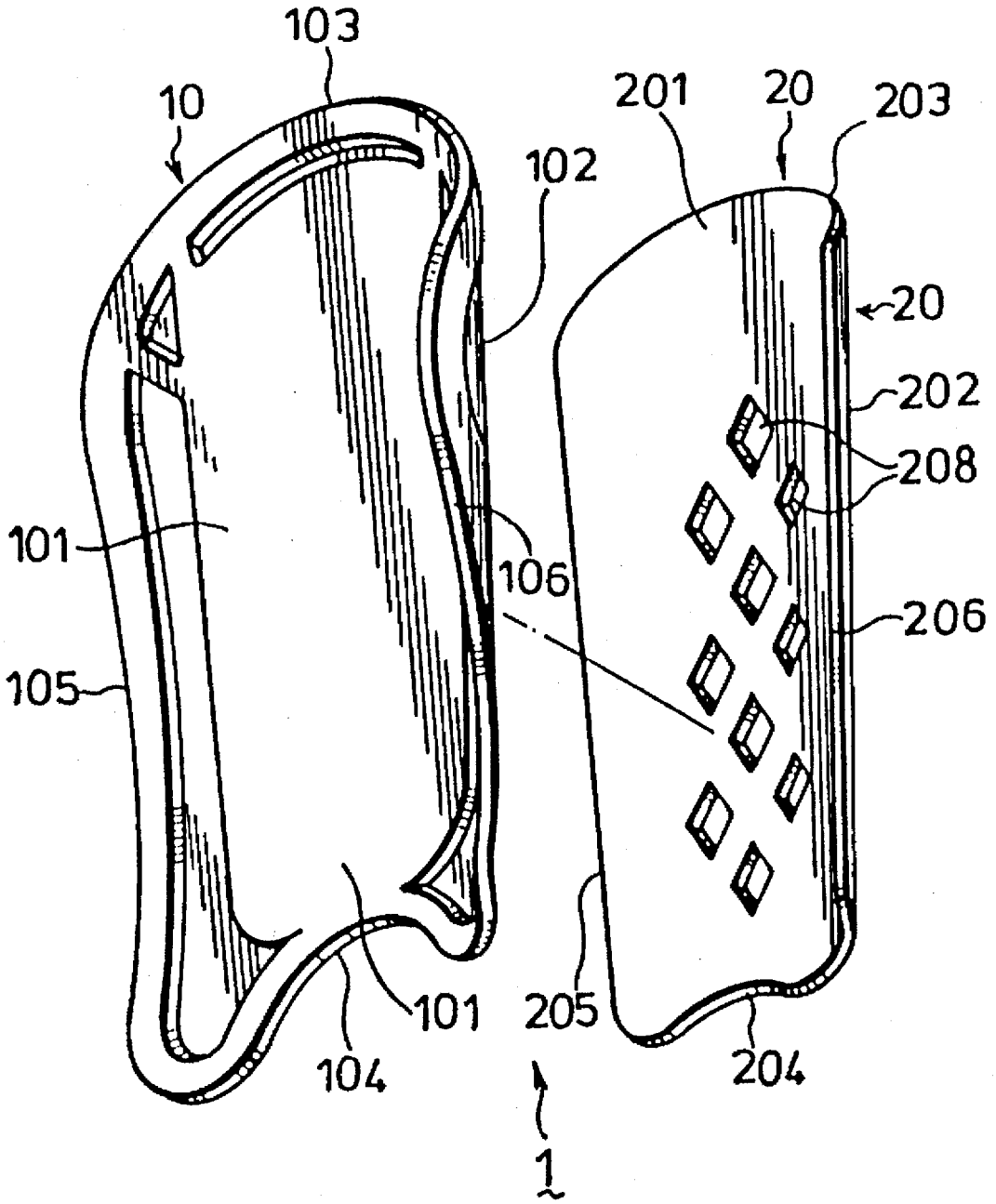
FIG. 1 shows a first preferred embodiment of a cushion device of the present invention.
Figure 2:
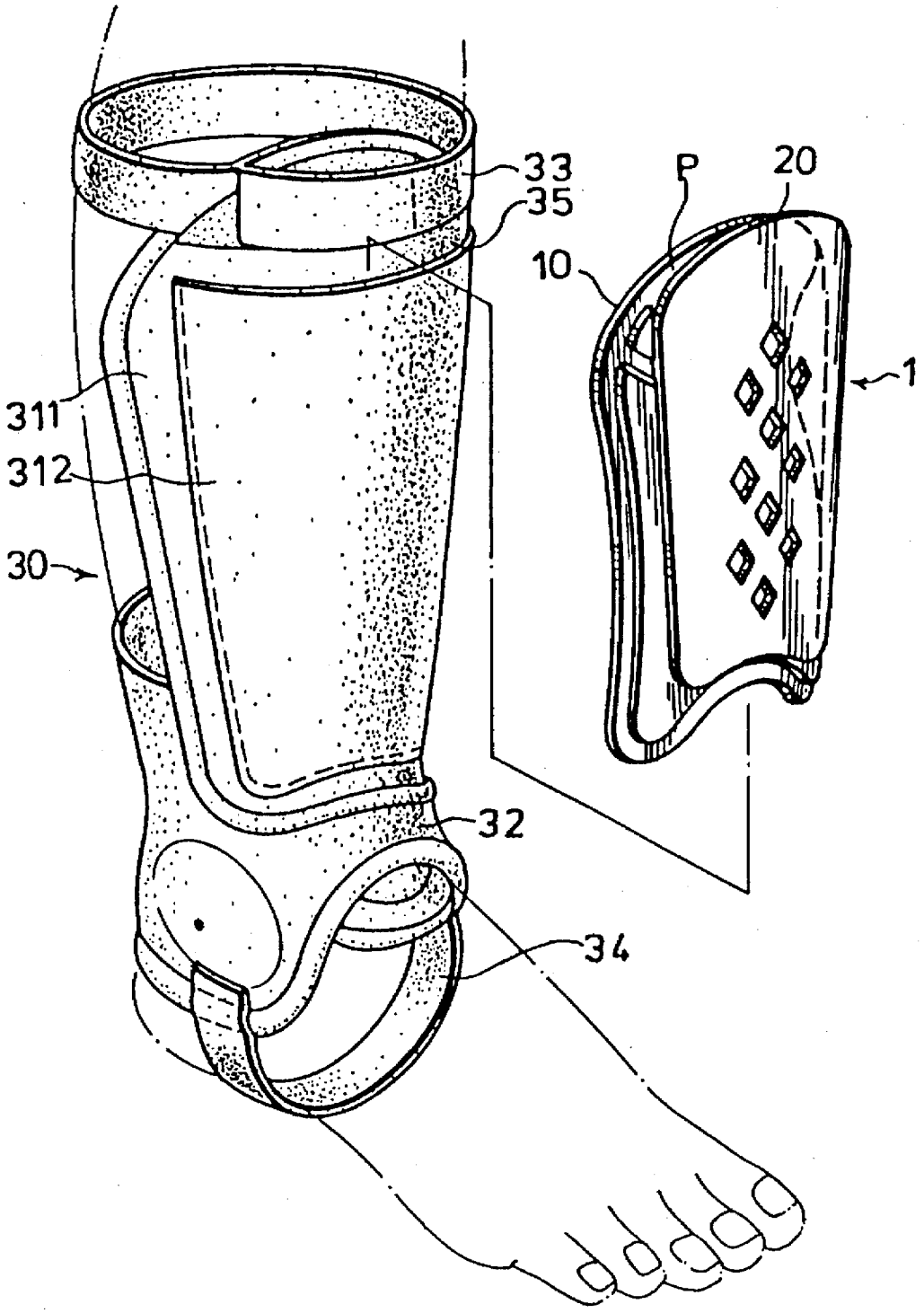
FIG. 2 illustrates the cushion device of the present invention to be disposed in a carrying bag which is worn around a body part.

Referring to FIG. 1, the first preferred embodiment of a cushion device 1 of the present invention is to be disposed in a carrying bag 30, as shown in FIG. 2, to protect a body part from collision. The cushion device 1 includes two curved plates 10, 20 with different radii of curvature.

The carrying bag 30, which is made of a substantially flexible material, is generally worn around a body part, such as a leg, and includes a first layer 311 with a lower portion that is connected integrally to an ankle sleeve 32 And an upper portion that is provided with a hook and loop fastener VELCRO strap 33, and a second layer 312 which is stitched partially to the first layer 311 so as to form a receiving space between the two layers 311, 312 and an entry 35 for access into the receiving space. The ankle sleeve 32 is provided with a suspension strap 34.

Figure 3:
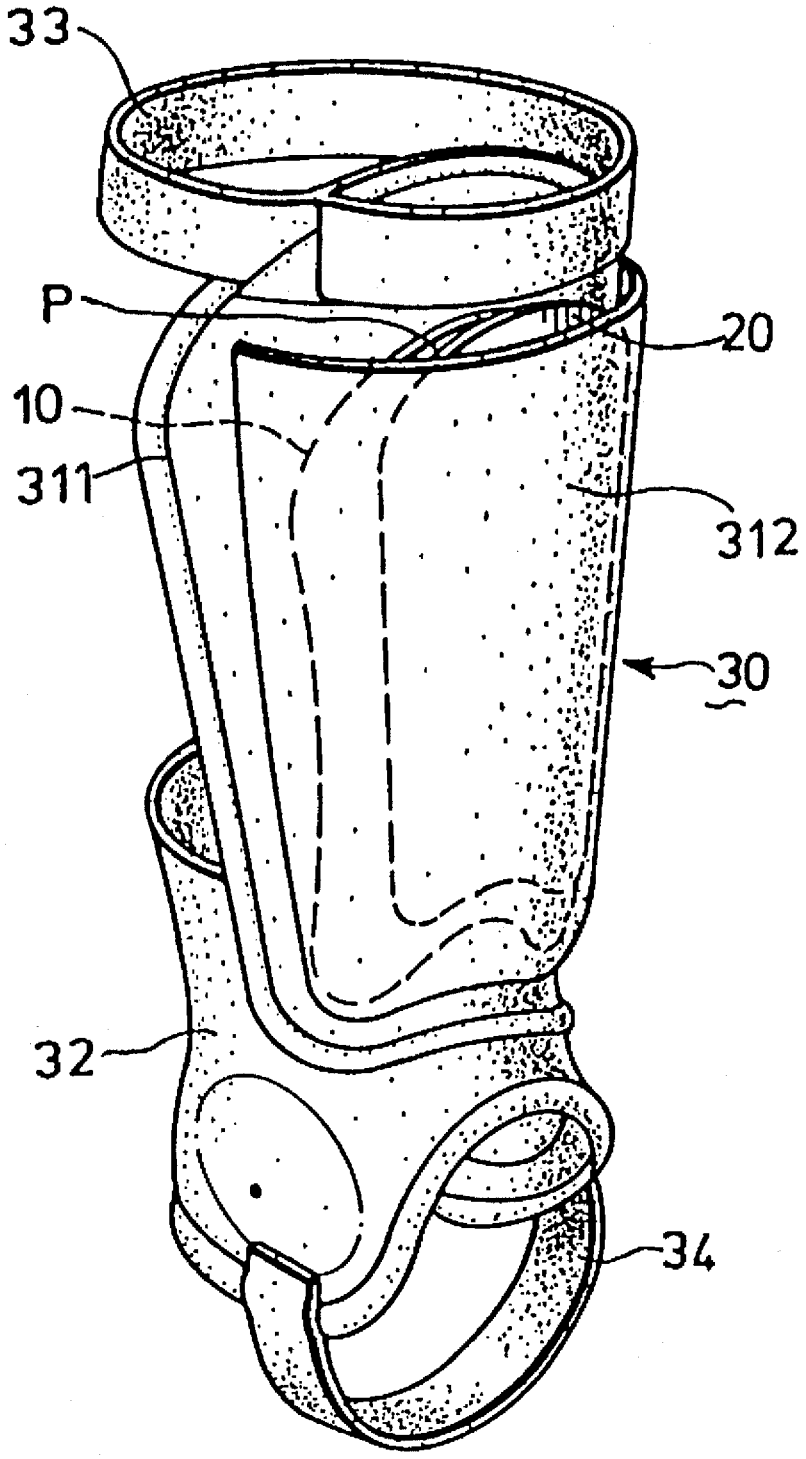
FIG. 3 illustrates the cushion device of the present invention when disposed within the carrying bag shown in FIG. 2.
Figure 4:
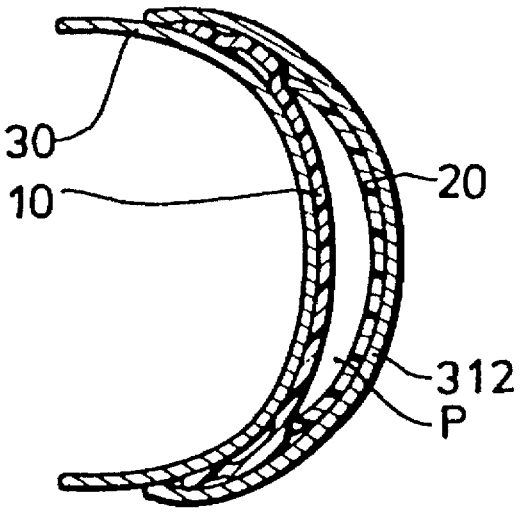
FIG. 4 shows a cross section of the cushion device of the present invention when disposed within the carrying bag.

In this embodiment, each of the curved plates 10, 20 is an elongated plate with a concave face 101, 201 and a convex face 102, 202 opposite to the concave face 101, 201. The concave and convex faces 101, 102 or 201, 202 are defined by two common end edges 103, 104 or 203, 204 and two common longitudinal peripheries 105, 106 or 205, 206 which extend respectively between the two common end edges 103, 104 or 203, 204. The curved plate 20 has a smaller radius of curvature while the curved plate 10 has a greater radius of curvature. The curved plate 20 is connected to the curved plate 10 such that the longitudinal peripheries 205, 206 of the former attached integrally to the convex face 102 of the latter by the use of known high frequency heat sealing methods. As shown in FIG. 4, a void (P) is formed between the curved plates 10, 20. Thus, as shown in FIG. 3, the cushion device 1 can be placed into the receiving space of the carrying bag 30 via the entry 35.

Figure 5:
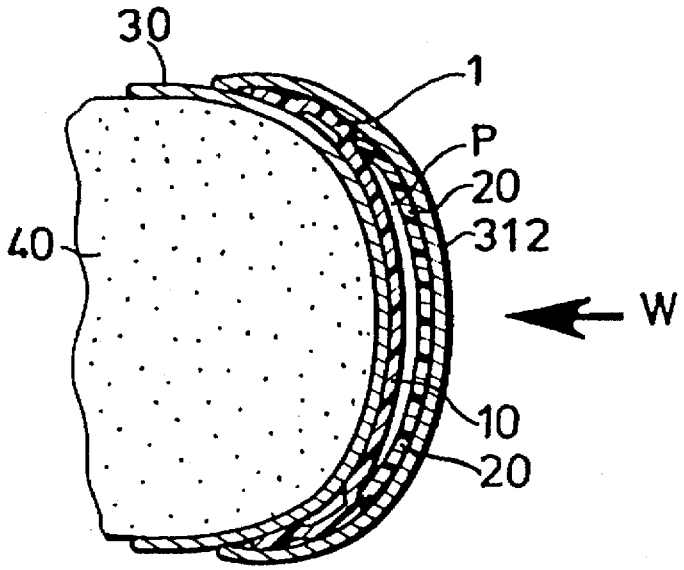
FIG. 5 illustrates deformation of the cushion device of the present invention when an impact is applied thereto.

Referring to FIG. 5, when the cushion device 1 is subjected to an impact force (W), the curved plate 20 is deformed, thereby reducing the void (P). Since the curved plates 10, 20 are made of an elastic material, the curved plate 20 reverts to its initial shape as soon as the impact force (W)

is removed. The carrying bag 30 permits limited expansion and compression to conform with the deformation of the cushion device 1.

Figure 6:
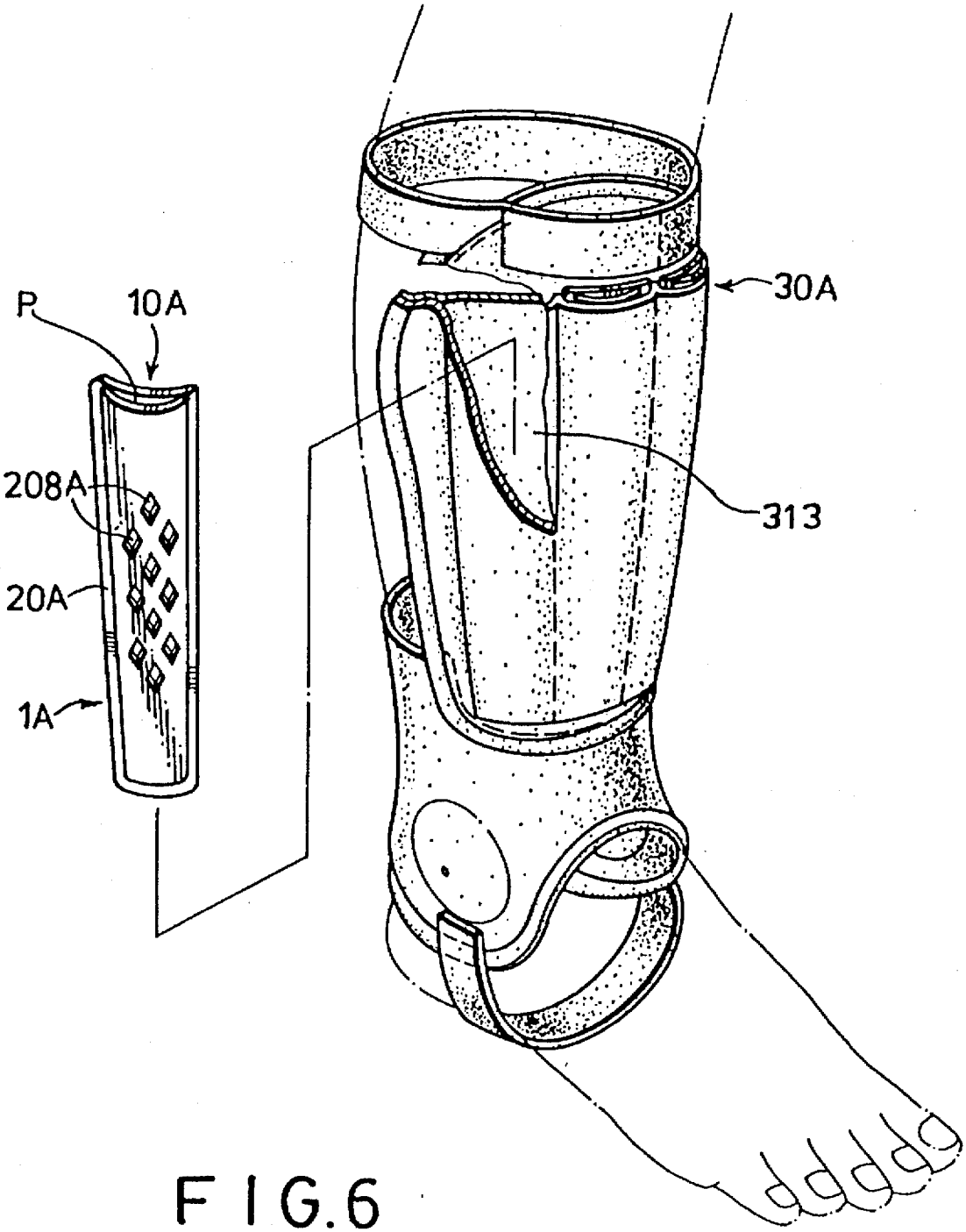
FIG. 6 shows a second preferred embodiment of the cushion device of the present invention before insertion into a carrying bag.

Referring to FIG. 6, in a second preferred embodiment of the present invention, the cushion device 1A includes a pair of curved plates 10A, 20A which differ from the previously described embodiment in size. Due to its smaller size, a plurality of cushion devices 1A can be disposed in a carrying bag 30A which is provided with a plurality of receiving spaces 313. The carrying bag 30A is to be suspended around a body part to protect the latter.

The curved plates 20, 20A of the first and second preferred embodiments are further provided with a plurality of openings 208, 208A, each of which has two pairs of parallel sides defining two pairs of opposed corners. One of the pairs of the corners is oriented in a longitudinal direction of the respective curved plate 20, 20A. The openings 208, 208A facilitate expansion and retraction of the curved plates 20, 20A.

Figure 7:
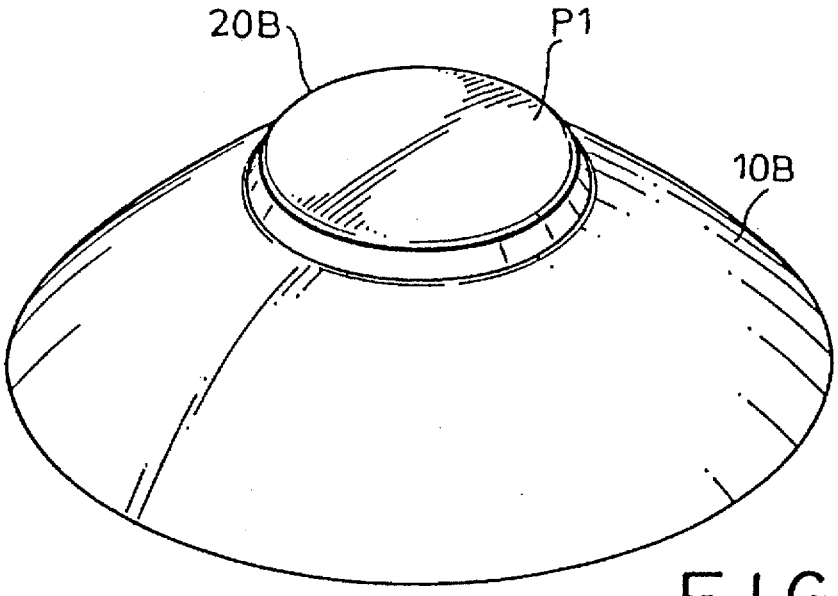
FIG. 7 illustrates a third preferred embodiment of the present invention.

Referring to FIG. 7, in a third preferred embodiment, the curved plates 10B, 20B are shaped as saucers and have the same relation therebetween as in the previously described embodiments. After placing the curved plate 20B which has a smaller radius of curvature on the convex face of the curved plate 10B which has a greater radius of curvature, the circular common periphery of the former is connected to the convex face of the curved plate 10B by high frequency heat sealing, thereby forming the void (P1) between the two saucer-shaped curved plates 10B, 20B.

Figure 8:
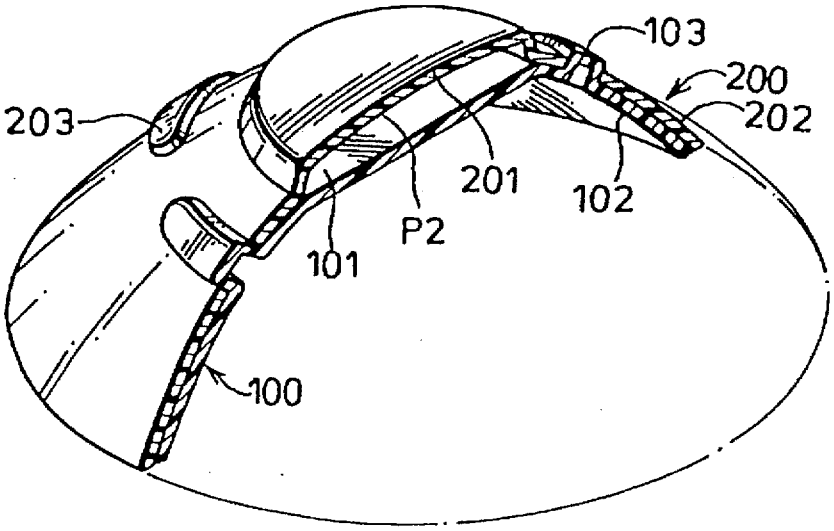
FIG. 8 shows a sectional view of a fourth preferred embodiment of the cushion device of the present invention.
Figure 9:
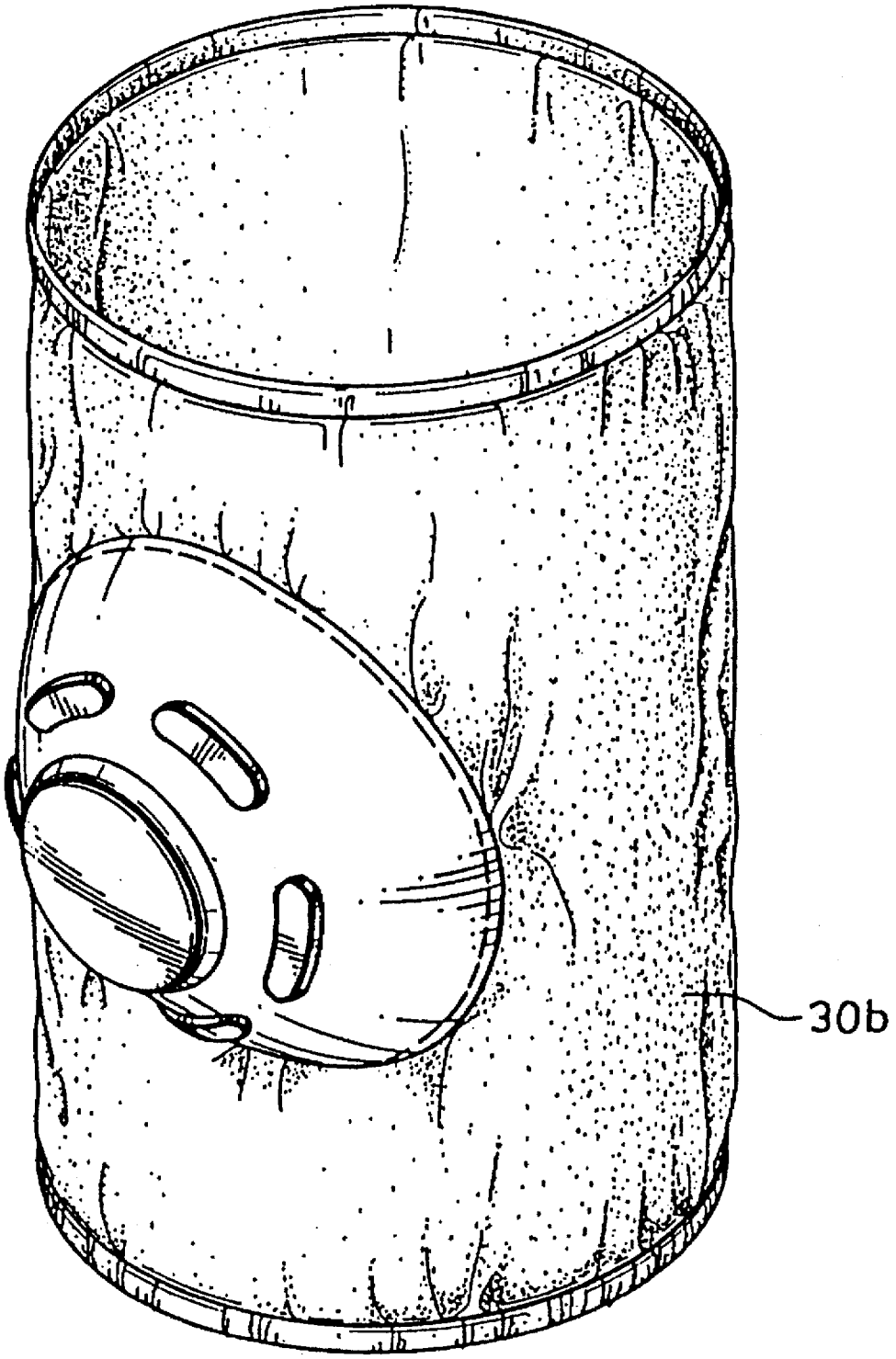
FIG. 9 shows the third or fourth preferred embodiment when disposed in a carrying bag which is to be worn around a body part.

Referring to FIG. 8, in a fourth preferred embodiment, the two curved plates 100, 200 are also shaped as saucers. Each of the curved plates 100, 200 has a central portion 101, 201 and a peripheral portion 102, 202 which surrounds the central potion 101, 202. The peripheral portion 202 of the curved plate 200 has the same radius of curvature as the peripheral portion 101 of the curved plate 100, while the central portion 201 of the curved plate 200 has a radius of curvature smaller than the radius of curvature of the peripheral portion. The central portion 101 of the curved plate 100 has a radius of curvature greater than the same radius of curvature of the peripheral portion. Since the central portion 101 of the curved plate 100 of this embodiment is a flat portion, it has an infinite radius of curvature which is greater than that of the central portion 201 of the curved plate 200. The curved plate 200 with the smaller radius of curvature is provided with a circle of circumferential slots 203 formed through the peripheral portion 202, while the curved plate 100 with an infinite radius of curvature has a plurality of protrusions 103 which protrude integrally from the convex face of the peripheral portion 102 around the central portion 101. When the curved plate 100 is inserted into the curved plate 200, the protrusions 103 of the curved plate 100 extend into the slots 203 of the curved plate 200, thereby interconnecting the two curved plates 100, 200. The void (P2) is formed between the central portion 201 of the curved plate 200 with the smaller radius of curvature and the central portion 101 of the curved plate 100 with the infinite radius of curvature. When the cushion device, shown in FIGS. 7 or 8, is placed in the carrying bag 30B (see FIG. 9), which is to be worn over the knee to protect the same as shown in FIG. 9, the cushion device within the carrying bag 30B provides an efficient cushion effect when the carrying bag 30B is subjected to impact, thereby protecting the knee from injuries.

With the present invention thus explained, it is obvious to those skilled in the art that various modifications and variations can be made without departing from the scope and spirit of the same. It is therefore intended that this invention be limited only as in the appended claims.

I claim:

1. A cushion device adapted to be disposed in a carrying bag to protect a body part from collision comprising:

two curved plates with different radii of curvature, said curved plates being connected to each other and forming a void therebetween, each of said curved plates having a central portion and a peripheral portion around said central portion, said peripheral portion of one of said curved plates having the same radius of curvature as said peripheral portion of the other one of said curved plates, said central portion of said one of said curved plates having a radius of curvature smaller than said radius of curvature of said peripheral portion, said central portion of the other one of said curved plates having a radius of curvature greater than said same radius of curvature of said peripheral portion.

2. The cushion device as defined in claim 1, wherein said central portion of the other one of said curved plates is a flat portion with an infinite radius of curvature, said curved plate having said central portion with said smaller radius of curvature being sleeved onto said curved plate having said central portion with said infinite radius of curvature so as to form said void between said central portion with said smaller radius of curvature and said central portion with said infinite radius of curvature.

* * * * *